United States Patent [19]

Bredeson

[11] 3,980,013

[45] Sept. 14, 1976

[54] SPLIT WORM FOR SCREW PRESS

[75] Inventor: Dean K. Bredeson, Piqua, Ohio

[73] Assignee: The French Oil Mill Machinery Company, Piqua, Ohio

[22] Filed: Sept. 15, 1975

[21] Appl. No.: 613,102

[52] U.S. Cl. ..... 100/117; 100/150; 259/191; 198/670; 425/208; 198/676

[51] Int. Cl.[2] ..... B30B 9/12

[58] Field of Search ..... 100/117, 145–150; 259/191–193, 9, 10; 425/207, 208; 198/213

[56] References Cited

UNITED STATES PATENTS

| | | | |
|---|---|---|---|
| 635,868 | 10/1899 | Peck | 198/213 |
| 2,014,636 | 9/1935 | Rosendahl | 259/97 |
| 3,721,184 | 3/1973 | French et al. | 100/150 X |

*Primary Examiner*—Peter Feldman
*Attorney, Agent, or Firm*—Biebel, French & Nauman

[57] ABSTRACT

An interrupted flight screw press is provided, especially in regions of heavier wear, with one or more longitudinal split worm bodies. The bodies have axially extending end flanges which hook underneath flanges of adjacent collars to hold the worm in place. One or both of the worm bodies are keyed or otherwise fastened to the shaft for driving. Relatively slight longitudinal movement of one or both adjacent collars will release the parts of the worm body for repair and/or replacement without disassembling the entire worm-collar-shaft assembly.

4 Claims, 3 Drawing Figures

SPLIT WORM FOR SCREW PRESS

BACKGROUND OF THE INVENTION

This invention relates to interrupted flight screw presses, and more particularly to the worm and collar arrangement used in such presses.

Screw presses generally include a cage with inlet and outlet at opposite ends, defining a pressing chamber through which a rotatable screw assembly extends.

Each worm includes an annular body with an integral helical flight which extends circumferentially around all or almost all of the body, such as a worm where the flight extends circumferentially about 340° around the body. The worms and flights are spaced axially by collars also mounted on the shaft, and some means is provided for resisting rotation of material within the chamber to cause axial flow of material from each worm to the next successive worm. Typically, breaker bars or lugs project inwardly toward the collars for this purpose.

The screw assembly comprises a series of axially spaced worms mounted on a shaft and the wear pattern varies as the internal pressure increases and the fluids contained within the pressed solids drains away. Frequently, only the worms in the heavy wear locations need be replaced after an extended running period.

In operation, the shaft is supported and driven from one end and lateral components of forces acting on the cantilever mounted screw assembly can cause wear on the outer surface of the worms. In an arrangement where a cantilevered shaft is driven from the feed end, the wear is especially pronounced on the last few worms of the screw assembly since that end of the assembly is subject to greater lateral deflection. In many presses the extremely high pressure generated near the discharge end of the screw press coupled with the higher friction from a compacted material from which most of the fluids have been drained causes more rapid erosion of the flights and bodies of the worms than in the feed and/or low pressure end of the screw press. When the screw press is used for expressing liquids from material containing abrasives, for example, sugar cane bagasse having particles of sand therein, the wear is still further accelerated.

To minimize wear on the worms, hard coating on the outer surface of the flights and bodies of the worms has been employed, particularly on the worms closest to the discharge end of the press. Also cage contractions have been provided (as in U.S. Pat. No. 3,093,605) to make it easier to obtain access to the screw assembly to replace worm parts. But, it is still necessary to withdraw the worms and collars over the end of the shaft in order to replace worn or damaged worms.

In presses used for the drying or dewatering of synthetic rubber materials, it is sometimes necessary to provide for pressure changes (increase or decrease) beyond the range available through adjustment of the press core. Also, some presses have a drive connection at the discharge end of the press, (as in U.S. Pat. No. 3,276,354), and the tendency is for heavier wear to occur in the region of the discharge. Thus, whether it is desirable to change a number of worms and/or collars, or only one or more near the discharge end, it is desirable to minimize down-time of the press for such changes.

Also, presses used in some applications where corrosive liquids or materials are involved are provided with stainless steel parts, for example, shafts, worms, and worm bodies, etc. If it is necessary to slide a stainless steel worm body along a stainless steel shaft, of any appreciable difference, there is a tendency for these parts to gall; therefore, it is advantageous to minimize the amount of negative longitudinal movement between these parts necessary for replacement of the worm bodies.

SUMMARY OF THE INVENTION

The present invention is directed to a mechanical screw press incorporating an improved pressing worm which is ideally suited for use particularly as the final discharge sections of the press, as well as at other locations on the screw shaft.

The improvement comprises a worm body longitudinally split into at least two pieces having cooperating sections of worm flight thereon, and cooperating axially extending flanges or ribs extending therefrom. Additionally, the collars on opposite sides of the improved worm body are provided with cooperating undercuts providing a ring-like extension to fit over the flanges on the worm bodies and to hold the pieces of the split worm body onto the shaft. In this way, the split worm body may be readily removed from the shaft by moving at least one of the adjoining collars axially away from the worm body, allowing the pieces to be moved free in a sideways motion. A new split worm can be placed on the shaft and the collars slipped back to close and hold the new worm. This eliminates the necessity to slide all the worms and collars the full length of the shaft and off, and reassemble to replace one or more worn worms.

Accordingly, it is an object of this invention to provide an improved worm body which is split such that it may be readily removed as two or more pieces from the shaft by moving the adjoining collars axially away from the worm bodies to release the pieces from retaining parts of the collars which hold the pieces in assembled relation around the shaft.

Other objects and advantages of the invention will be apparent from the following description, the accompanying drawings and the appended claims.

DETAILED DESCRIPTION OF THE INVENTION

Figure 1:
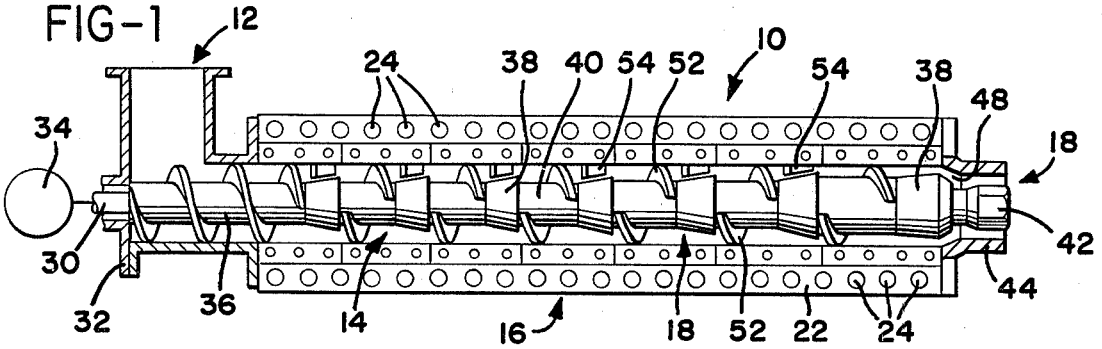
FIG. 1 is a side elevational view of a screw press with one half of the cage removed to expose the screw assembly and with the feed end shown in section.

Referring to the drawings, and particularly to FIG. 1, the press 10 which is illustrated is a continuous duty, interrupted flight, screw type machine. The press generally comprises an inlet hopper 12 through which materials to be worked upon and treated are supplied, a pressing chamber 14, formed by outer cage structure 16, an outlet 18, and a screw assembly 20 extending through said chamber 14.

The cage 16 is comprised of two symmetrical halves or sections 22 (only one being illustrated), each of which is semicylindrical in shape so that the chamber 14 is generally cylindrical. The sections 22 may be clamped together by a series of tie bolts (not shown) which extend within the holes 24, or by some other means.

The screw assembly includes a shaft 30 mounted for rotation in the upstanding end wall 32 of the inlet end of the press 10, and driven rotatably from either end by conventional drive 34, which may include any suitable form of power together with a gear case or the like by which the desired rotation of the shaft is obtained. Mounted on the shaft 30 are a feed screw 36, which receives the material to be worked on between the flights thereof and carries the material into the main body of the pressing chamber 14, and a plurality of collar members 38 and worms 40.

The worms 40 are keyed or otherwise secured to shaft 30 for rotation with the shaft and collars 38 may also be keyed to shaft 30. All of the feed screws 36, the collars 38 and worms 40 will be held on shaft 30 by an end or retainer nut 42. The cage structure 16 shown is of constant diameter and has a discharge outlet 18 comprised of a stationary discharge ring 44 mounted on the discharge end of the press 10 and in surrounding relation to the last collar 38. The ring is preferably slidable axially to define a variable discharge orifice 48.

The collar members 38 and bodies 50 of the worms 40 cooperate with the interior walls of the cage structure 22 to provide a through annular passage, i.e., pressing chamber 14, for the material, with such passage varying in cross-sectional area at different locations. As the material is fed through the pressing chamber 14 it is compressed and worked between the outer surfaces of the collars 38 and worm bodies 50 and the interior walls of the cage 22. The flights 52 (which may be notched) take up the material and move it along the length of the pressing chamber 14. Stationary breaker lugs 54, which are attached to the inner wall of the cage 22, are provided between the worms to restrain rotation of the material with the collars 38, and to cooperate with the worm flights 52 to obtain a tearing, shearing and working action of the material and to cause it to move in an axial direction so that it is eventually discharged out orifice 48.

At least some of the collars 38, usually the last one or more, will be tapered, i.e., they will increase progressively in cross-section, so that a restricted pressing annulus is formed and the material is subjected to increasing pressure for purposes of extracting fluids from or working the material. For this reason, it is normally the last worm or several worms which are subjected to the greatest forces and consequential wear.

Figure 2:
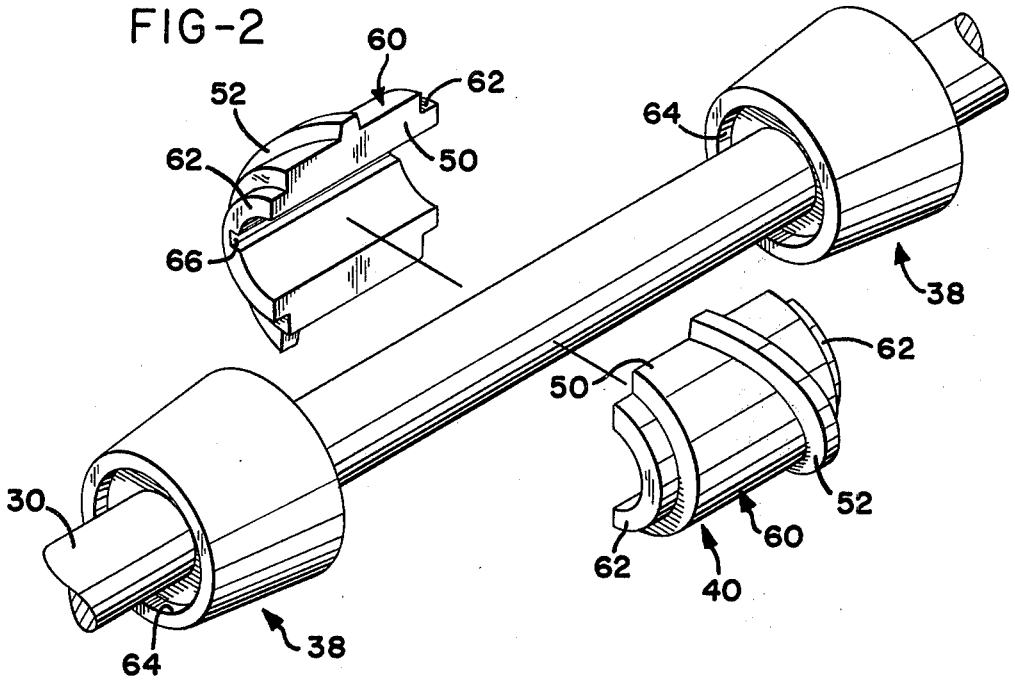
FIG. 2 is an exploded view of a portion of the screw assembly showing an improved worm in accordance with the teachings of the invention.
Figure 3:
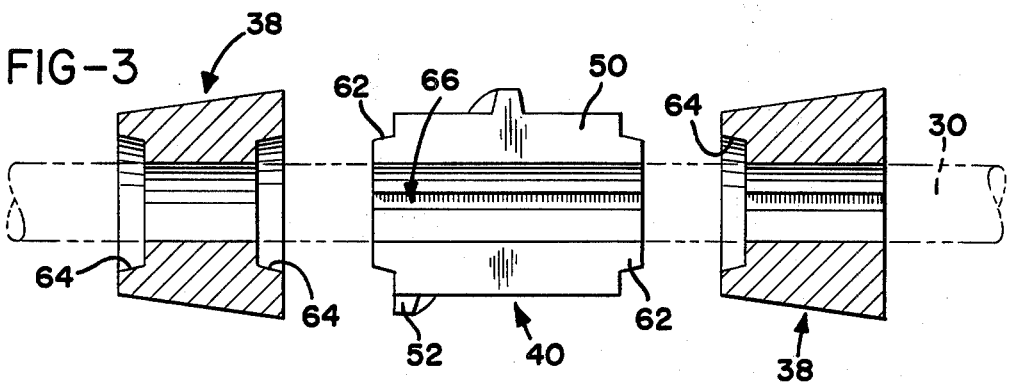
FIG. 3 is a view with the shaft shown in phantom lines and with the collars spaced axially away from one piece of the worm body.

In accordance with the present invention and in order to make the worms readily replaceable, the bodies 50 of the worms 40 have been longitudinally split into several pieces 60 which have portions of the helical worm flight 52 thereon. As shown in FIG. 2, there are two pieces 60, although the worm body 50 could be split into more. The worm bodies 50 have ribs or flanges 62 extending axially therefrom which are engaged by axially extending ring-like retainers 64 formed by undercuts in the end of the collar 38 which engages the flanges 62 of the worms 40. The collars 38 can have undercuts 64 in either or both ends depending on how many split worms it will engage. Also the flanges and retainers may be tapered to facilitate their alignment and engagement.

When the pieces 60 are brought together on shaft 30, they will be held thereon by the retainers 64 which will overlie the flanges 62, effectively clamping the pieces 60 to the shaft 30. Keyways 66 are provided in at least one, preferably both, of the pieces 60 for keying them to shaft 30 for rotation therewith. End nut 42 will axially hold the collars 38 and worms 40 on the shaft 30.

It is not necessary that all of the worms be "split worms" since the worms closest to the inlet do not necessarily wear as fast. When it becomes necessary to replace a worn worm, the end nut can be removed and the collars 38 moved axially along the shaft 30 as necessary, then as shown in FIG. 2, the pieces of the worm body are pulled sideways from the shaft, replaced or repaired, and the collars are returned into engaging relationship with the worm body pieces.

In some installations it may be desirable to use a spacer collar or sleeve (not shown) which is split longitudinally, with its parts held together by suitable fastening means. This spacer collar can then be removed to provide space to move the collars 38 axially along the shaft 30 as necessary to release the split worms. Such a spacer collar normally would be located outside the pressing cage at either end.

While the form of apparatus herein described constitutes a preferred embodiment of this invention, it is to be understood that the invention is not limited to this precise form of apparatus, and that changes may be made therein without departing from the scope of the invention.

What is claimed is:

1. In a mechanical screw press for expressing fluid from a material, including a cage having means defining an elongated pressing chamber with an inlet end and a discharge end, a rotatable screw assembly extending through said chamber and including a shaft, a series of axially aligned worm members mounted on said shaft and having corresponding bodies and helical flights projecting outward from the bodies, a series of collars located on said shaft between the worm bodies, at least said worm members being connected to rotate with said shaft, means for rotating the screw assembly, and means for resisting rotation of said material within the chamber as it moves toward the discharge end in response to the rotation of the screw assembly; the improvement comprising at least one of said worm bodies being longitudinally split into pieces having cooperating sections of worm flight thereon and cooperating flanges extending axially therefrom, and releasable retainers fitted over said flanges and holding the pieces of said split worm body around said shaft whereby the split worm body may be readily removed from said shaft by releasing said retainers from said worm body.

2. Apparatus as defined in claim 1, in which said retainers are ring-like extensions on the collars adjoining said split worm body, and said retainers are released by moving at least one of said adjoining collars along said shaft.

3. A mechanical screw press as in claim 2 further including at least one spacer collar which is split longitudinally into pieces which may be readily removed from said shaft to provide space along said shaft to move said adjoining collars apart.

4. A mechanical screw press as in claim 1 wherein said split worm body is divided into two generally semicylindrical pieces.

* * * * *